US006234411B1

(12) United States Patent
Walker et al.

(10) Patent No.: US 6,234,411 B1
(45) Date of Patent: May 22, 2001

(54) COMBINED NOZZLE SET AND LIFT TOOL FOR A POP-UP SPRINKLER

(75) Inventors: Samuel C. Walker, Upland; David Robertson, Glendora, both of CA (US)

(73) Assignee: Anthony Manufacturing Corporation, Residential Products Division, Azusa, CA (US)

( * ) Notice: Subject to any disclaimer, the term of this patent is extended or adjusted under 35 U.S.C. 154(b) by 0 days.

(21) Appl. No.: 09/591,149

(22) Filed: Jun. 9, 2000

(51) Int. Cl.[7] ..... B05B 15/00; B05B 1/00

(52) U.S. Cl. ..... 239/289; 239/201; 239/203; 239/600; 29/280

(58) Field of Search ..... 239/200, 201, 239/203, 204, 205, 206, 207, 210, 289, 465, 580, 600; 81/488; 29/278, 280

(56) References Cited

U.S. PATENT DOCUMENTS

| | | | | |
|---|---|---|---|---|
| D. 415,415 | * | 10/1999 | Robertson | D9/344 |
| 1,962,534 | * | 6/1934 | Sweetland | 239/201 X |
| 3,977,063 | * | 8/1976 | Bruninga | 239/205 X |
| 4,788,894 | * | 12/1988 | Mitschele | 81/488 |
| 5,868,316 | * | 2/1999 | Scott | 239/206 X |

* cited by examiner

*Primary Examiner*—David A. Scherbel
*Assistant Examiner*—Robin O. Evans
(74) *Attorney, Agent, or Firm*—Kelly Bauersfeld Lowry & Kelley, LLP

(57) ABSTRACT

A combined nozzle set and lift tool is provided for use with a pop-up sprinkler, wherein the lift tool comprises a tool body in the form of an injection molded runner formed integrally with a plurality of individual nozzle inserts. An elongated tool stem projects outwardly from the tool body and has protruding tabs at a tip end thereof for reception into an undercut recess formed in a pop-up sprinkler spray head to permit lifting of the spray head from a normal position spring-retracted substantially within a sprinkler housing or case, to an elevated position for facilitated access to the spray head. A selected one of the plurality of nozzle inserts can be separated from the lift tool as by snap-off detachment, whereupon the selected nozzle insert can be mounted on the elevated spray head to individually tailor the characteristics of a water stream projected therefrom during normal sprinkler operation. The lift tool further includes latch teeth for snap-fit engagement with the spray head to permit storage of the combined nozzle set and lift tool on the spray head, to provide a convenient commercial unit which can be transported to an installation site with little or no risk of components becoming lost or misplaced.

32 Claims, 5 Drawing Sheets

COMBINED NOZZLE SET AND LIFT TOOL FOR A POP-UP SPRINKLER

BACKGROUND OF THE INVENTION

This invention relates generally to irrigation sprinklers of the type having a pop-up spray head with a removably mounted nozzle insert selected to provide an outwardly projected water stream having a predetermined spray pattern. More particularly, this invention relates to a combined nozzle set and lift tool wherein a plurality of nozzle inserts are detachably carried by a mold runner shaped to form a convenient lift tool for engaging and lifting a sprinkler spray head to facilitate interchangeable mounting of a selected nozzle insert thereon.

Pop-up irrigation sprinklers are well known in the art particularly for use in irrigation systems wherein it is necessary or desirable to embed the sprinkler in the ground so that it does not project appreciably above ground level when not in use. In a typical pop-up sprinkler, a sprinkler mechanism is housed within a generally cylindrical upright sprinkler case having an open upper end. In a normal inoperative position, a pop-up portion of the sprinkler mechanism including a spray head is normally spring-retracted substantially into the sprinkler case so that it does not extend or project a significant distance above the case. However, when water under pressure is supplied to the sprinkler case, the spray head is displaced upwardly to an elevated spraying position spaced above the sprinkler case to facilitate the delivery of an outwardly projected stream of irrigation water to a surrounding terrain area and associated vegetation.

In many pop-up sprinkler designs, the sprinkler mechanism includes rotary drive means for rotating the elevated spray head through continuous full circle revolutions, or alternately back and forth within a predetermined part-circle arcuate path, to sweep the projected water stream over a selected target terrain area. In this regard, the spray head for the rotary drive pop-up sprinkler is frequently adapted for removable mounting of a selected one of a set of spray nozzle inserts designed to custom-tailor the specific characteristics of the projected water stream, such as flow rate, trajectory, stream width, and the like, in accordance with the particular irrigation requirements for each pop-up sprinkler. For examples of rotary drive pop-up sprinklers of this general type, see U.S. Pat. No. 4,625,914 and 4,787,558. In addition, such rotary drive pop-up sprinklers are commercially available from Rain Bird Sprinkler Mfg. Corp. of Glendora, Calif. under the product designations T-Bird Series, R-50, Falcon, and Talon.

In the past, interchangeable nozzle inserts for a pop-up sprinkler spray head have been economically produced from lightweight molded plastic to have a size and shape for quick and easy removable mounting on the spray head. In one form, such nozzle inserts have been produced in a unitized set formed integrally with a common mold runner which comprises a convenient carrier for storing and transporting the nozzle set. See, for example, U.S. Pat. No. Des. 415,415. The multiple nozzle inserts of the nozzle set define nozzle flow paths of different geometric configurations to yield projected water streams having different selected spray characteristics when mounted onto the spray head of a pop-up sprinkler. At an in-the-field installation site, typically at the time of initial installation of an irrigation system, a selected one of the nozzle inserts can be detached quickly and easily from the mold runner carrier for mounting onto a sprinkler spray head to custom-select the spray pattern of the water stream to be delivered therefrom. Thereafter, periodic changing of the nozzle insert can be required to tailor the specific water spray characteristics according to the maturation and growth of the surrounding vegetation, or alternately according to changes in the vegetation type. However, such interchangeable nozzle inserts have typically been provided as a component or components separate from the associated pop-up sprinkler, whereby the nozzle inserts have been susceptible to being lost or misplaced.

Another problem encountered with rotary drive pop-up sprinklers is that the spray head is not readily accessible for facilitated removal of a pre-installed nozzle insert or for installation of a new one. More particularly, in the normal inoperative position, the spray head is retracted substantially into the sprinkler case by a biasing spring which retains the spray head substantially seated and sealed against an upper portion of the sprinkler case with a sufficient force to minimize ingress of dirt and other contaminants into the case interior. Moreover, to provide the pop-up sprinkler with the desired low profile in the normal inoperative state, the spray head typically does not include any significant surface protrusions to facilitate manual grasping and lifting to access the spray head for installing a nozzle insert. To address this problem, specialty lift tools have been developed to engage and lift the spray head against the downward force of the biasing spring to a sufficiently elevated position to accommodate installation of a nozzle insert. However, such lift tools have also comprised separate components which are susceptible to being lost or misplaced.

The present invention overcomes these problems and disadvantages by providing a combined nozzle set and lift tool for a pop-up sprinkler, wherein a molded set of nozzle inserts is carried by a mold runner shaped for additional use as a lift tool to engage and lift a sprinkler spray head for facilitated removable mounting of a selected nozzle insert thereon.

SUMMARY OF THE INVENTION

In accordance with the invention, a combined nozzle set and lift tool is provided for use with a pop-up sprinkler, wherein the nozzle set comprises a plurality of nozzle inserts molded integrally with and detachably carried by a mold runner. The mold runner is shaped to form a convenient lift tool adapted to engage and lift a sprinkler spray head from a normal inoperative position retracted substantially into a sprinkler housing or case, to a sufficiently elevated position to permit facilitated mounting of a selected one of the nozzle inserts onto the spray head.

In the preferred form of the invention, the nozzle set comprises the multiple nozzle inserts each having an external size and shape for interchangeable mounting onto a sprinkler spray head, but wherein the nozzle inserts define individual nozzle flow paths of different geometric configurations to provide projected water streams of different predetermined characteristics such as flow rate, trajectory, and stream width when mounted onto the sprinkler spray head. The multiple nozzle inserts are formed as injection molded appendages coupled respectively by narrow sprue necks to the lift tool mold runner. In the preferred form, the mold runner comprises a generally circular or disk-shaped tool body having the nozzle inserts carried about the periphery thereof. An elongated tool stem projects radially outwardly from the tool body with at least one and preferably a pair of outwardly protruding tabs or ears formed at a tip end thereof. In addition, at least one and preferably a pair of latch teeth are formed on the underside of the tool body for releasably engaging a spray head of a pop-up sprinkler.

In use, the combined nozzle set and lift tool can be transported in an integral or one-piece configuration to an installation site for mounting of a selected one of the nozzle inserts onto the spray head of a pop-up sprinkler. In the preferred configuration, the combined nozzle set and lift tool is mounted on and transported with an associated pop-up sprinkler by snapfit mounting in a storage position onto the top of the spray head by means of the latch teeth on the tool body. The selected nozzle insert can be separated quickly and easily from the lift tool mold runner as by snap-off detachment wherein the associated sprue neck is severed by bending or twisting. The lift tool can be separated quickly and easily from the spray head and then re-oriented to insert the tip end of the tool stem into an undercut recess formed in the top of the spray head, with the protruding tabs on the tool stem engaging the spray head for facilitated lifting to raise the spray head to a sufficiently elevated position to accommodate mounting of the selected nozzle insert thereon.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
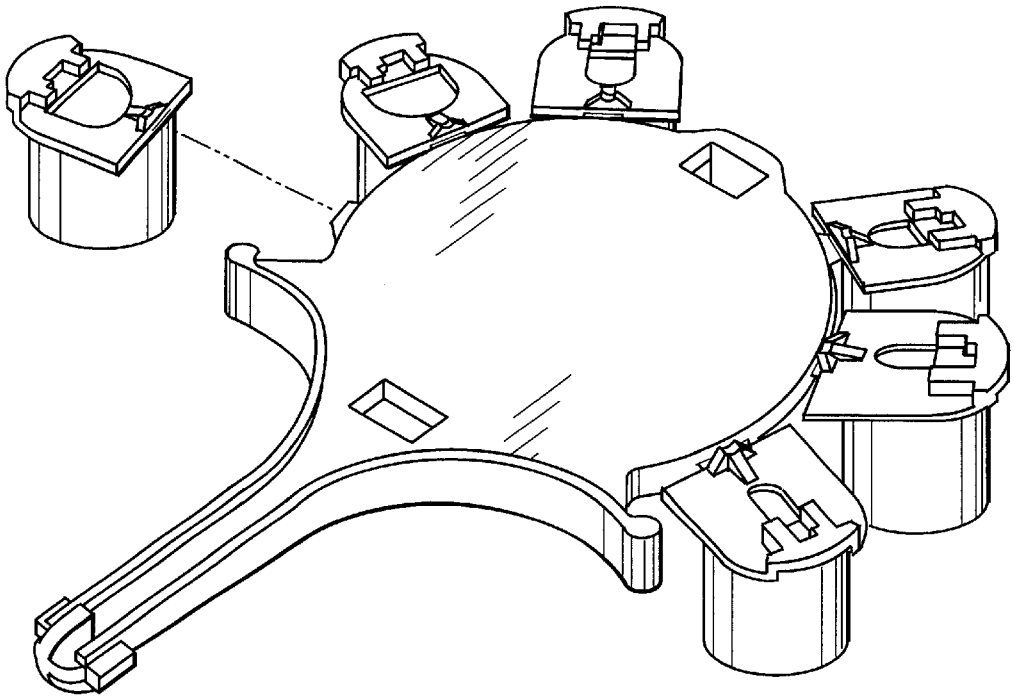
FIG. 1 is a partially exploded top perspective view of a combined nozzle set and lift tool embodying the novel features of the invention.
Figure 2:
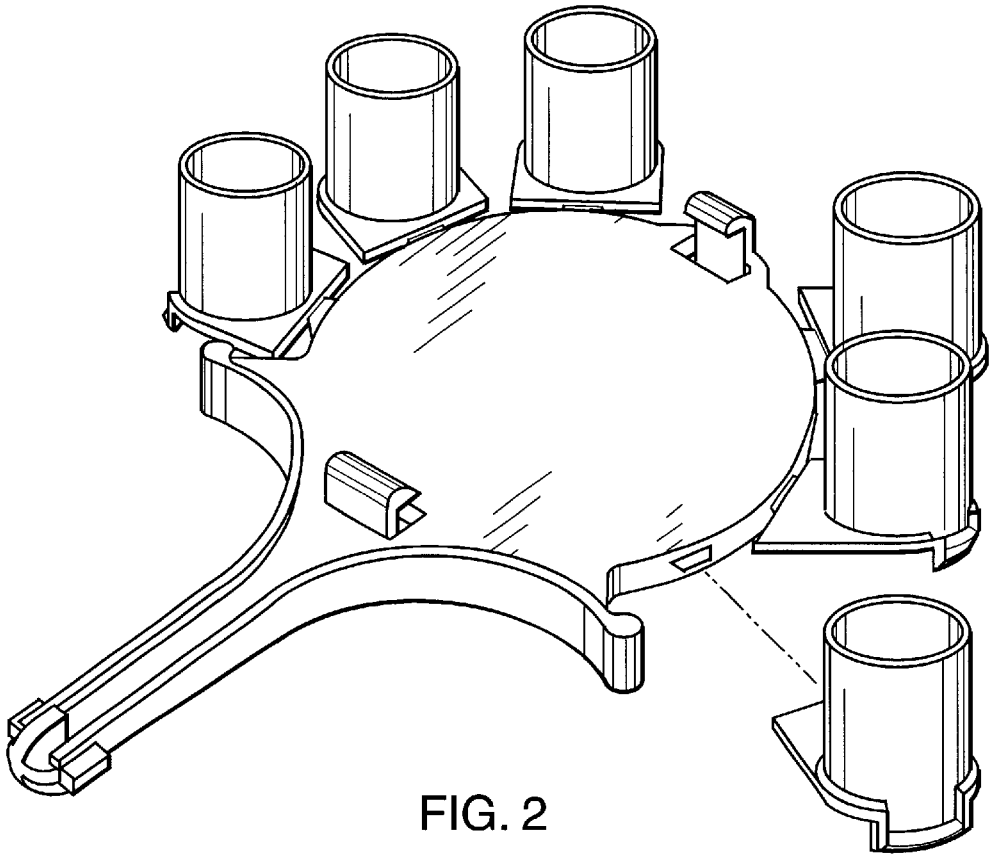
FIG. 2 is a partially exploded bottom perspective view of the combined nozzle set and lift tool of FIG. 1.

As shown in the exemplary drawings, a combined nozzle set and lift tool referred to generally by the reference numeral 10 in FIGS. 1 and 2 is provided for use with a pop-up sprinkler 12 as viewed in FIGS. 4–10. The combined nozzle set and lift tool 10 comprises at least one and preferably a plurality or set of nozzle inserts 14 each adapted for removable mounting onto a spray head 16 of the pop-up sprinkler 12. These nozzle inserts 14 are carried by a mold runner which is shaped to provide a convenient and easy-to-use lift tool for engaging and lifting the spray head 16 (FIGS. 8–10) to a sufficiently elevated position to accommodate facilitated mounting of a selected one of the nozzle inserts 14 onto the spray head 16.

Figure 4:
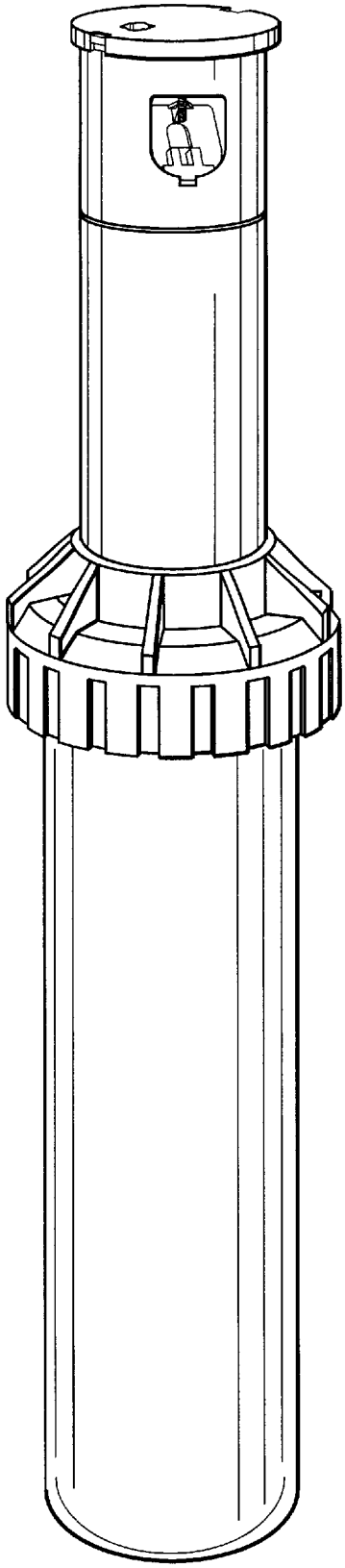
FIG. 4 is a perspective view showing an illustrative pop-up sprinkler having a spray head in an elevated spraying position for delivering irrigation water to a surrounding terrain area.
Figure 5:
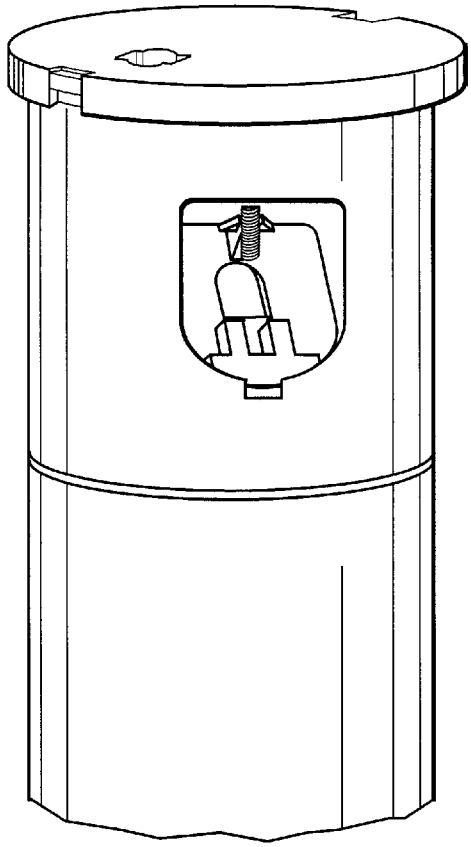
FIG. 5 is an enlarged fragmented perspective view of the sprinkler spray head of FIG. 4.
Figure 6:
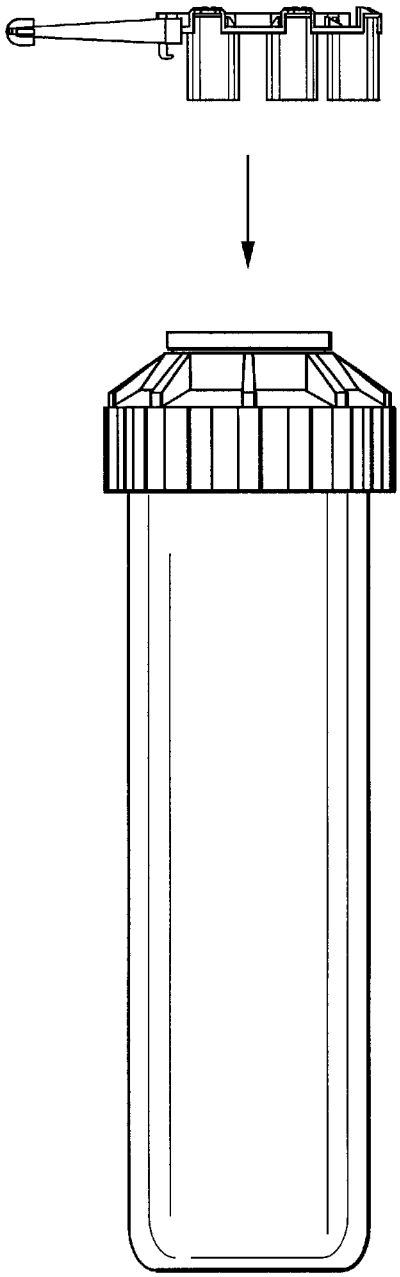
FIG. 6 is an exploded elevation view depicting snap-fit mounting of the lift tool onto the spray head of a pop-up sprinkler.

The combined nozzle set and lift tool 10 of the present invention is designed for use with a pop-up sprinkler 12 of the type having a rotary drive mechanism (not shown) for rotating the elevated spray head through continuous full circle revolutions, or alternately back and forth within a predetermined part-circle arcuate path, to sweep the projected water stream over a selected target terrain area. In this regard, as shown best in FIGS. 4–6, the spray head 16 is mounted at the upper end of a pop-up riser 20 which is mounted in turn within a sprinkler housing or case 22 for movement with the spray head 16 between a normal position retracted into and substantially concealed within the case 22 (FIG. 6), and the elevated spraying position (FIG. 4). The riser 20 and spray head 16 thereon are slidably movable through a central opening 24 (FIG. 4) formed in an annular cap 26 mounted on an upper end of the case 22. A retraction spring (not shown) normally urges the riser 20 and spray head 16 downwardly to the normal retracted position, with a small radially outwardly projecting flange 28 on a top wall 29 of the spray head 16 being seated firmly against the case cap 26, as shown in FIG. 6. When water under pressure is supplied to the sprinkler case 22, typically through an inflow port (not shown) at the case bottom, the riser 20 is shifted upwardly by the water under pressure to the elevated spraying position with the spray head 16 positioned above the upper extent of the case 22 and associated cap 26, as viewed in FIG. 4.

Figure 3:
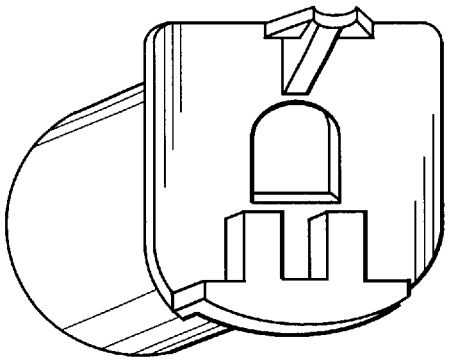
FIG. 3 is an enlarged perspective view showing a selected one of a plurality of nozzle inserts separated from the combined nozzle set and lift tool of FIGS. 1 and 2.

In the elevated spraying position, the spray head 16 projects a water stream or spray 30 radially outwardly to irrigate surrounding terrain and vegetation. The rotary drive mechanism for the pop-up sprinkler 12 is normally mounted within the sprinkler case 22 and/or within the interior of the riser 20 and functions to rotate the spray head 16 in a manner sweeping the projected water stream 30 through continuous full circle revolutions or alternately back and forth within the boundaries of a predetermined arcuate path. Importantly, the specific spray characteristics of the projected water stream 30, such as flow rate, trajectory, stream width, and the like, are controlled by the geometry of the nozzle insert 14 mounted on the spray head 16 and defining a nozzle flow path 32 through which the water stream 30 is projected. One illustrative nozzle insert 14 is shown in FIG. 3, to include a generally cylindrical body 34 in combination with a face plate 36 suitable for mounting as by snap-fit reception or the like into a nozzle cavity 38 (FIG. 5) formed in one side of the spray head 16. A set screw 40 or the like (FIG. 5) on the spray head 16 may be provided for extending partially into the projected water stream 30 for additionally tailoring the stream configuration, wherein the set screw 40 may also engage a bracket 41 (shown best in FIG. 3) of the face plate 36 to assist in retaining the nozzle insert 14 within the nozzle cavity 38. For examples of rotary drive pop-up sprinklers of this general type, see U.S. Pat. Nos. 4,625,914 and 4,787,558. In addition, such rotary drive pop-up sprinklers are commercially available from Rain Bird Sprinkler Mfg. Corp. of Glendora, Calif. under the product designations T-Bird Series, R-50, Falcon, and Talon.

The combined nozzle set and lift tool 10 of the present invention comprises the mold runner having the set of nozzle inserts 14 carried thereon, wherein the nozzle inserts 14 each have substantially the same exterior geometric configuration suitable for seated mounting onto the spray head 16 of a particular model pop-up sprinkler 12. However, as shown in FIG. 1, the individual nozzle inserts 14 carried by the mold runner exhibit individual nozzle flow paths 32 of different geometries for providing the projected water stream 30 with different predetermined spray pattern characteristics. For example, the set of nozzle inserts 14 may be formed to provide a selection of different water stream spray trajectories, widths, flow rates, and the like. The combined nozzle set and lift tool 10 permits selection of one specific nozzle insert 14, according to the current irrigation requirements associated with a particular sprinkler 12 in an irrigation system, for quick and easy installation of the selected nozzle insert 14 onto the spray head 16 of the particular sprinkler. In this regard, a combined nozzle set and lift tool 10 of the present invention may be provided with each pop-up sprinkler 12 as part of the original commercial unit, whereupon the sprinkler 12 may be purchased without regard to spray pattern and then individually custom-tailored by the installer to optimize the water stream spray pattern according to the current irrigation needs associated with each individual sprinkler. Thereafter, the lift tool 10 and unused nozzle inserts 14 attached thereto can be retained to permit quick and easy changing of the nozzle insert 14 when and if a different water stream spray pattern is required at a future date.

The combined nozzle set and lift tool 10 is economically formed as a unitary or one-piece plastic component by injection molding. The lift tool mold runner is formed during the injection molding process as a flow gallery for passage of molten plastic material through a mold (not shown) and further through a series of narrow sprue necks 42 (FIGS. 1 and 2) to form the set of nozzle inserts 14. In this regard, the mold runner is formed to have a generally circular disk-shaped central tool body 44 with the set of nozzle inserts 14 joined to the periphery thereof by the narrow sprue necks 42. While the illustrative drawings show a total of six nozzle inserts 14 carried by the tool body 44, it will be recognized and understood that the specific number of nozzle inserts 14 may vary.

The lift tool mold runner further includes an elongated tool stem 46 formed generally coplanar with the tool body 44 and extending radially outwardly from the periphery thereof. This tool stem 46 has a distal or outer tip end thereof formed with at least one and preferably a pair of short tabs or ears 48 protruding outwardly therefrom in opposite directions. At the base or inboard end of the tool stem 46, generally at the juncture thereof with the tool body 44, a pair of wing-shaped and contoured finger grips 50 project outwardly relative to the tool stem in opposite directions, generally coplanar to the tool body 44. In addition, the tool stem 46 is formed generally in-line with at least one and preferably a pair of latch teeth 52 which depend from the underside of the tool body 44 at diametrically opposed positions generally adjacent the periphery thereof. As shown best in FIG. 2, these latch teeth 52 extend downwardly from the disk-shaped tool body 44 and include radially inturned lower ends.

Figure 7:
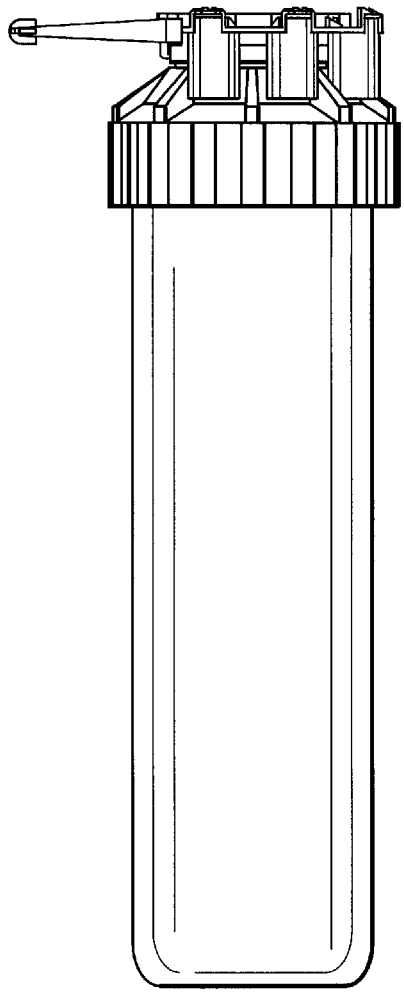
FIG. 7 is an elevation view similar to FIG. 6, but showing the spray head in a normal position retracted substantially within a sprinkler case.
Figure 8:
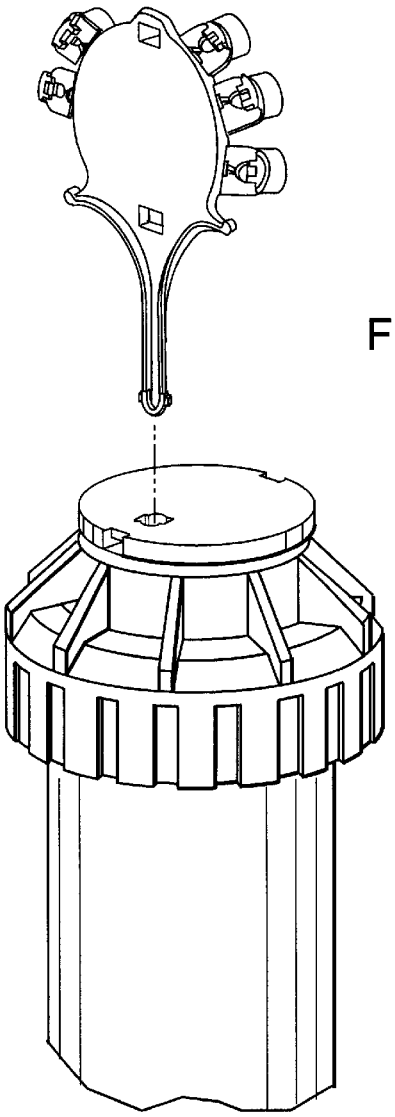
FIG. 8 is a fragmented perspective view of an upper end of a pop-up sprinkler, and illustrating engagement of the lift tool with the sprinkler spray head for lifting the spray head relative to a sprinkler case.

The latch teeth 52 have a size and shape for engaging the peripheral margin of the flange 28 formed on the top wall 29 of the spray head 16, for purposes of mounting the combined nozzle set and lift tool 10 onto the sprinkler 12 in a convenient storage position (FIGS. 6–7). This engagement takes place substantially with a snap-fit, and may be facilitated by formed the spray head flange 28 to include matingly shaped and undercut notches 54 (shown best in FIGS. 4–5) located at generally diametrically opposed positions on the spray head. In this storage position, the combined nozzle set and lift tool 10 is securely attached to the associated sprinkler 12 to form a unitized commercial unit which can be displayed for sale, sold to a customer, and transported to an in-the-field installation site without separated or loose parts that are susceptible to becoming lost.

When it is desired to access the sprinkler spray head 16 for installing a selected one of the nozzle inserts 14 thereon, either during initial sprinkler installation or for subsequently changing the nozzle insert to achieve a different spray pattern, the mold runner is utilized as a lift tool to engage and elevate the spray head. More particularly, the lift tool 10 is detached from the normal storage position on the top of the spray head 16. The lift tool 10 is then re-oriented relative to the spray head 16 (FIG. 8) to insert the tip end of the tool stem 46 downwardly into a keyhole-shaped port 56 (FIG. 9) formed in the top wall 29 of the spray head 16. The keyhole port 56 leads to an undercut recess 58 (FIG. 10). By rotating the tool 10 approximately 90° relative to the spray head 16, the stem tabs or ears 48 are rotated within the undercut recess 58 to a position for engaging the underside of the top wall 29. In this position, the lift tool 10 can be manually lifted to raise the spray head 16 from the normal retracted position toward the elevated spraying position by merely pulling upwardly on the curved finger grips 50 formed on the lift tool 10.

Figure 9:
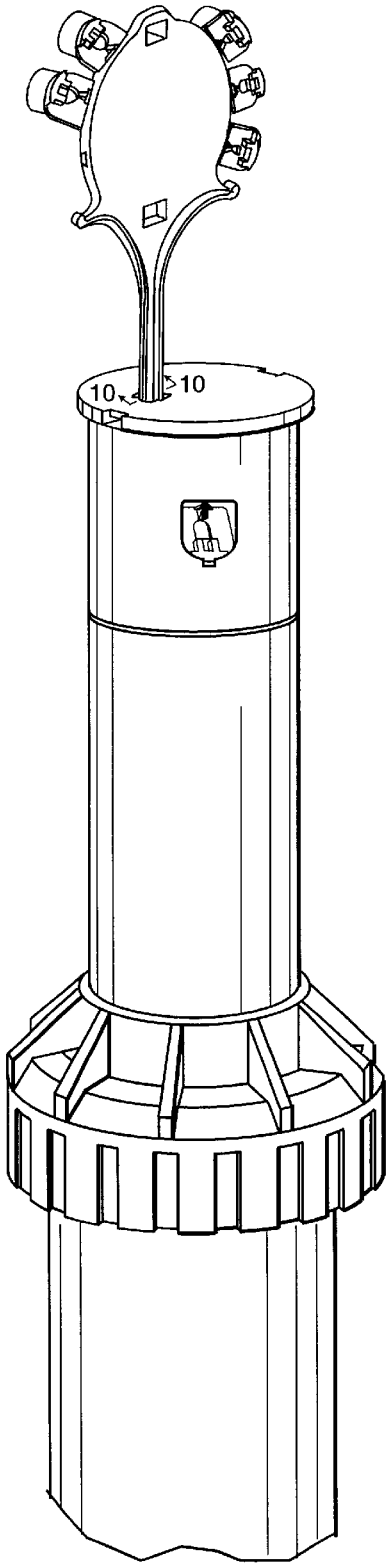
FIG. 9 is a fragmented perspective view similar to FIG. 8, and showing use of the lift tool to lift and retain the sprinkler spray head substantially in an elevated spraying position.
Figure 10:
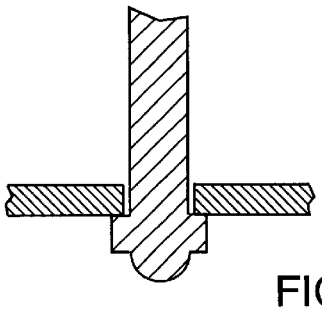
FIG. 10 is an enlarged fragmented sectional view taken generally on the line 10—10 of FIG. 9.

While using the lift tool 10 to hold the spray head 16 in the elevated position, as viewed in FIG. 9, the chosen nozzle insert 14 can be installed quickly and easily onto the spray head. Such installation may be incident to original set-up installation of the irrigation system, or it may occur at a later time when irrigation requirements warrant replacement of an existing nozzle insert with a new or different one to provide a modified water stream spray pattern. The selected nozzle insert 14 is readily separated from the tool body 44 by snap-off detachment wherein the associated sprue neck 42 is severed by appropriate bending or twisting. When the desired nozzle insert 14 is fully installed, the lift tool 10 can be manipulated to return the spray head 16 to the normal retracted position and then reoriented for separation of the tool stem 46 from the spray head. It will be recognized and understood that the unused nozzle inserts 14 may remain attached to the lift tool during the entire nozzle insert installation process. Importantly, with this invention, there is no need for service or maintenance personnel to acquire and maintain any specialty lift tool or implement to lift the spray head for nozzle insert installation, or to carry separate nozzle insert to an in-the-field irrigation system.

A variety of modifications and improvements in and to the combined nozzle set and lift tool of the present invention will be apparent to those persons skilled in the art. Accordingly, no limitation on the invention is intended by way of the foregoing description and accompanying drawings, except as set forth in the appended claims.

What is claimed is:

1. A combined nozzle set and lift tool for use with an irrigation sprinkler having a pop-up spray head movable between a normal position retracted substantially within a sprinkler case and an elevated spray position, said combined nozzle set and lift tool comprising:

a lift tool for engaging and lifting a pop-up spray head of an irrigation sprinkler to an elevated position; and at least one nozzle insert detachably carried by said lift tool for separation therefrom and installation onto the spray head;

said lift tool and said at least one nozzle insert being formed as a unitary plastic molding.

2. The combined nozzle set and lift tool of claim 1 wherein said lift tool comprises a mold runner, and further wherein said at least one nozzle insert is coupled to said mold runner by a relatively narrow sprue neck.

3. The combined nozzle set and lift tool of claim 1 wherein said lift tool comprises a mold runner, and further wherein said at least one nozzle insert comprises a plurality of nozzle inserts coupled respectively to said mold runner by relatively narrow sprue necks.

4. The combined nozzle set and lift tool of claim 1 wherein said lift tool comprises a generally disk-shaped tool body, and an elongated tool stem projecting generally outwardly from said tool body, said tool stem including means for engaging and lifting a pop-up spray head of an irrigation sprinkler.

5. The combined nozzle set and lift tool of claim 4 wherein said engaging and lifting means on said tool stem comprises at least one outwardly protruding tab formed generally at a distal end thereof.

6. The combined nozzle set and lift tool of claim 4 wherein said engaging and lifting means on said tool stem comprises a pair of tabs protruding outwardly therefrom in opposite directions generally at a distal end thereof.

7. The combined nozzle set and lift tool of claim 4 further including at least one latch member formed on one side of said tool body.

8. The combined nozzle set and lift tool of claim 7 wherein said at least one latch member comprises a latch tooth.

9. The combined nozzle set and lift tool of claim 7 wherein said at least one latch member comprises a pair of latch teeth formed on said tool body at generally diametrically opposed positions for removable snap-fit engagement with a pop-up spray head of an irrigation sprinkler.

10. The combined nozzle set and lift tool of claim 9 wherein said pair of latch teeth are formed on said tool body at positions generally in-line with said tool stem.

11. The combined nozzle set and lift tool of claim 4 wherein said at least one nozzle insert is connected by a relatively narrow sprue neck to said tool body generally at a periphery of said tool body.

12. The combined nozzle set and lift tool of claim 4 wherein said at least one nozzle insert comprises a plurality of nozzle inserts respectively connected by relatively narrow sprue necks generally at a periphery of said tool body.

13. The combined nozzle set and lift tool of claim 1 further including at least one finger grip formed on said lift tool.

14. The combined nozzle set and lift tool of claim 4 further including at least one finger grip formed on said lift tool generally at a base end of said tool stem.

15. The combined nozzle set and lift tool of claim 14 wherein said at least one finger grip comprises a pair of finger grips protruding outwardly generally in opposite directions relative to said tool stem.

16. The combined nozzle set and lift tool of claim 15 wherein said pair of finger grips are formed generally coplanar with said tool body.

17. A combined nozzle set and lift tool for use with an irrigation sprinkler having a pop-up spray head movable between a normal position retracted substantially within a sprinkler case and an elevated spray position, said combined nozzle set and lift tool comprising:

a mold runner defining a generally disk-shaped tool body, and an elongated tool stem extending generally radially outwardly from said tool body; and at least one nozzle insert molded integrally with said mold runner and detachably connected generally to a periphery of said tool body by a relatively narrow sprue neck;

said tool stem including means for releasible engagement with a pop-up spray head of an irrigation sprinkler whereby said mold runner comprises a lift tool for facilitated lifting of the spray head to an elevated position.

18. The combined nozzle set and lift tool of claim 17 wherein said at least one nozzle insert comprises a plurality of nozzle inserts respectively connected by relatively narrow sprue necks generally at a periphery of said tool body.

19. The combined nozzle set and lift tool of claim 17 wherein said means for releasible engagement with the spray head comprises at least one outwardly protruding tab on said tool stem generally at a distal end thereof.

20. The combined nozzle set and lift tool of claim 17 wherein said means for releasible engagement with the spray head comprises a pair of tabs on said tool stem and protruding outwardly therefrom in opposite directions generally at a distal end of said tool stem.

21. The combined nozzle set and lift tool of claim 17 further including at least one latch tooth formed on said tool body for removable snap-fit engagement with the spray head.

22. The combined nozzle set and lift tool of claim 17 further including at least one finger grip formed on said lift tool.

23. The combined nozzle set and lift tool of claim 22 wherein said at least one finger grip comprises a pair of finger grips protruding outwardly generally in opposite directions relative to said tool stem, said pair of finger grips being formed generally coplanar with said tool body.

24. A combined nozzle set and lift tool for use in combination with an irrigation sprinkler having a pop-up spray head movable between a normal position retracted substantially within a sprinkler case and an elevated spray position, the combination comprising:

a lift tool including means forengaging and lifting said pop-up spray head to the elevated position; and at least one nozzle insert formed integrally with said lift tool and detachably carried thereby for separation therefrom and installation onto the spray head;

said spray head including means formed thereon for releasible engagement by said lift tool engaging and lifting means whereby said lift tool can be used for facilitated manual lifting of the said spray head to the elevated position.

25. The combination of claim 24 wherein said lift tool comprises a generally disk-shaped tool body and an elongated tool stem extending generally radially outwardly therefrom, said means for engaging and lifting said spray head being formed on said tool stem generally at a distal end thereof.

26. The combination of claim 25 wherein said engaging and lifting means comprises at least one outwardly protruding tab member formed on said tool stem.

27. The combination of claim 25 wherein said engaging and lifting means comprises a pair of tab members formed on said tool stem and protruding outwardly therefrom in opposite directions.

28. The combination of claim 26 wherein said means formed on said spray head for engagement by said lift tool comprises means forming an undercut recess on said spray head, said undercut recess being upwardly exposed when said spray head is in the normal retracted position.

29. The combination of claim 24 wherein said at least one nozzle insert comprises a plurality of nozzle inserts respectively connected by relatively narrow sprue necks generally at a periphery of said tool body.

30. The combination of claim 24 further including at least one latch member carried by said lift tool for removable snap-fit engagement with said spray head.

31. The combination of claim 30 further including at least one undercut notch formed on said spray head for snap-fit engagement by said latch member carried by said lift tool.

32. The combination of claim 31 wherein said lift tool and said at least one nozzle insert carried thereby is supported on said spray head in a stored position without interfering with normal sprinkler operation when said latch member is snap-fit engaged with said undercut notch on said spray head.

* * * * *